US005940028A

United States Patent [19]

Iwamura

[11] Patent Number: 5,940,028

[45] Date of Patent: Aug. 17, 1999

[54] SYSTEM AND METHOD FOR ALIGNING AN ANTENNA

[75] Inventor: Ryuichi Iwamura, San Diego, Calif.

[73] Assignees: Sony Corporation, Tokyo, Japan; Sony Electronics, Inc., Park Ridge, N.J.

[21] Appl. No.: 09/163,761

[22] Filed: Sep. 30, 1998

[51] Int. Cl.[6] ..... H01Q 3/00

[52] U.S. Cl. ..... 342/359; 343/703

[58] Field of Search ..... 342/359; 343/703

[56] References Cited

U.S. PATENT DOCUMENTS 5,283,780 2/1994 Schuchman et al. .

5,748,677 5/1998 Kumar ..... 375/285

*Primary Examiner*—Theodore M. Blum

*Attorney, Agent, or Firm*—Frommer Lawrence & Haug, LLP.; William S. Frommer; Dennis M. Smid

[57] ABSTRACT

System and method for facilitating the positioning of an antenna adaptable for receiving transmitted signals wherein antenna alignment values obtained from equalizer tap-weight values are displayed so as to provide an indication as to whether or not the antenna is properly aligned. Such antenna alignment values may change gradually as the antenna is rotated or moved. As a result, an installer can easily position or point an antenna in the direction of the transmission site.

33 Claims, 6 Drawing Sheets

SYSTEM AND METHOD FOR ALIGNING AN ANTENNA

BACKGROUND OF THE INVENTION

The present invention relates to a technique for facilitating the alignment or positioning of an antenna adaptable for receiving transmitted signals.

In an analog broadcasting system (such as that associated with an NTSC TV system), analog television signals may be transmitted and received by a number of television receivers with the use of respective antennas. Each of such antennas may be aligned by moving or rotating the same until an acceptable picture is displayed on the respective television receiver. In such aligning of an antenna, the picture displayed on the television receiver may gradually change as the respective reception antenna is moved or rotated. As a result, the optimum or acceptable orientation or alignment of the antenna may be easily found.

In a digital television (DTV) broadcasting system, broadcasted DTV signals may be transmitted by way of a satellite or other type of relaying device(s) for reception by a number of television receivers with the use of antennas. Such broadcasted DTV signals may enable clearer pictures and sound to be produced by the television receivers as compared to those obtained from broadcasted analog NTSC television signals. However, in a DTV broadcasting system, it may be difficult to align an antenna so as to properly receive the broadcasted television signals. That is, DTV broadcasting may provide an all-or-nothing arrangement in which a television receiver may either properly receive a picture or may receive nothing at all. As such, there may be no "in-between" positions in which a somewhat acceptable/unacceptable picture is received, unlike in an analog NTSC broadcasting system. In other words, in DTV reception, decoded pictures may be obtained only when the antenna is aligned so as to be orientated within a relatively small angular range (such as +/−2.5 degrees) of the proper angular position. If the antenna is orientated so as to be at the end of the receivable angular span (which is a critical point), reception may become unstable with a relatively small movement of the antenna. That is, an acceptable picture may suddenly be displayed when the antenna is orientated within the small acceptable angular range and may suddenly disappear when the antenna is orientated so as to be outside the small acceptable angular range. As such, it may be difficult to align the antenna.

During the installation of an antenna for receiving broadcasted DTV signals, a so-called antenna meter may be utilized. Such antenna meter or antenna alignment value may be produced from an error rate of a received signal by a digital satellite receiver and may be displayed on a display unit. As an example, such antenna alignment value may lie within a range of 0 to 100 and may be presented in a bar format on a display 10, as shown in FIG. 6.

By observing the antenna alignment value, an installer is provided with an indication as to whether the current orientation of the antenna is acceptable or not. However, because the acceptable angular span is relatively narrow as previously described, the error rate or antenna alignment value may reach a limit on the bar display with only a relatively small angular movement of the antenna. Upon reaching such limit, the antenna alignment value may remain there until the antenna is moved so as to be orientated within the relatively narrow acceptable angular range.

Thus, the antenna alignment value may not gradually change as the antenna is moved or rotated. Accordingly, proper aligning or pointing of an antenna may be very difficult even with the use of the antenna meter.

Additionally, it may be desirable to receive broadcasted DTV signals which are transmitted in different directions. In such situation, the antenna needs to be aligned or positioned so as to receive the desired signals. As is to be appreciated, such positioning of the antenna may be more difficult than the above-described situation in which signals are transmitted in one direction.

OBJECTS AND SUMMARY OF THE INVENTION

An object of the present invention is to provide a technique for facilitating the alignment of an antenna adaptable for receiving transmitted signals.

More specifically, it is an object of the present invention to provide a technique as aforesaid wherein an antenna alignment value produced from equalizer tap-weight values obtained from the received signals provides an indication as to whether the antenna is properly aligned.

In accordance with an aspect of the present invention, a system for aligning an antenna is provided. Such system comprises a device for obtaining a number of equalizer tap-weight values from a received signal, and a device for determining an antenna alignment value from the obtained number of equalizer tap-weight values, wherein the antenna alignment value indicates whether the antenna is properly aligned.

Other objects, features and advantages according to the present invention will become apparent from the following detailed description of illustrated embodiments when read in connection with the accompanying drawings in which corresponding components are identified by the same reference numerals.

DESCRIPTION OF THE PREFERRED EMBODIMENTS

Figure 1:
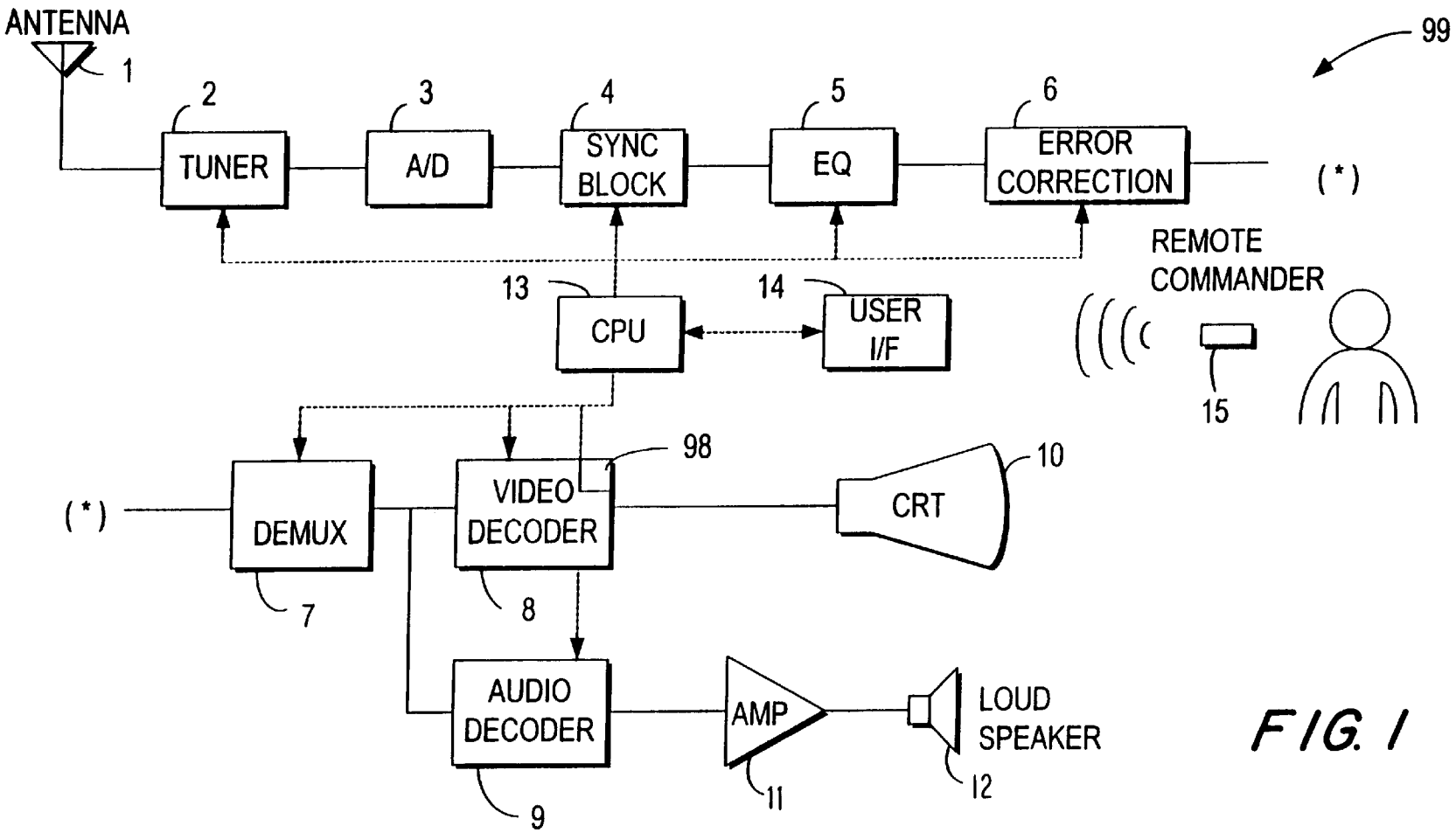
FIG. 1 is a diagram of a television receiver having an apparatus for aligning an antenna according to an embodiment of the present invention.

FIG. 1 illustrates a DTV system 99 according to an embodiment of the present application. Such system may include a tuner 2, a synchronizing block 4, an equalizer 5, an error correction circuit 6, a CPU 13, a demultiplexer 7, video and audio decoders 8 and 9, a display 10, and a speaker 12 which may be arranged as shown in FIG. 1.

Broadcast signals may be received by an antenna 1. The tuner 2 is adapted to enable a user to select a desired channel or signal from among the broadcasted signals, whereupon the selected signal is supplied to an analog-to-digital (A/D) converter 3 so as to be converted into a digital signal. Such digital signal is supplied to the sync block 4 so as to be synchronized or sync-locked. An output from the sync block 4 is supplied to the equalizer 5, wherein an equalizing process may be performed.

The error correction circuit 6 is adapted to receive an output from the equalizer 5 and perform an error correction operation thereon so as correct errors in the equalized signal. An error corrected output or transport stream is supplied from the error correction circuit 6 to the demultiplexer 7. The error correction circuit 6 may also produce packet error rate (PER) data for supply to the CPU 13.

The demultiplexer 7, which may be a parser-type demultiplexer, is adapted to demultiplex the received transport stream so as to form video and audio data which are respectively supplied to the video decoder 8 and the audio decoder 9. (A parser-type demultiplexer may identify the data as being audio data or video data and may perform a demultiplexing operation.) The video decoder 8 may decode the received video data and may perform a digital-to-analog (D/A) conversion so as to form analog video data. Such analog video data is supplied to the display 10, which may be a cathode ray tube (CRT), whereupon decoded pictures may be displayed. The audio decoder 9 may decode the received audio data and may perform a D/A conversion so as to form analog audio data. Such analog audio data may be supplied to an audio amplifier 11 so as to be amplified and the amplified audio data may be supplied to the loudspeaker 12.

The CPU 13, which may be a micro-controller type CPU, is adapted to generate control signals in response to commands received from a user and to supply such control signals to the appropriate one or ones of the tuner 2, the sync circuit 4, the equalizer 5, the error correction circuit 6, the demultiplexer 7, and the decoders 8 and 9 so as to control the operations of the same. The user commands may be produced from a user operated remote commander 15 which transmits signals corresponding to the user commands to a user interface 14 which, in turn, supplies command signals to the CPU 13.

Figure 2:
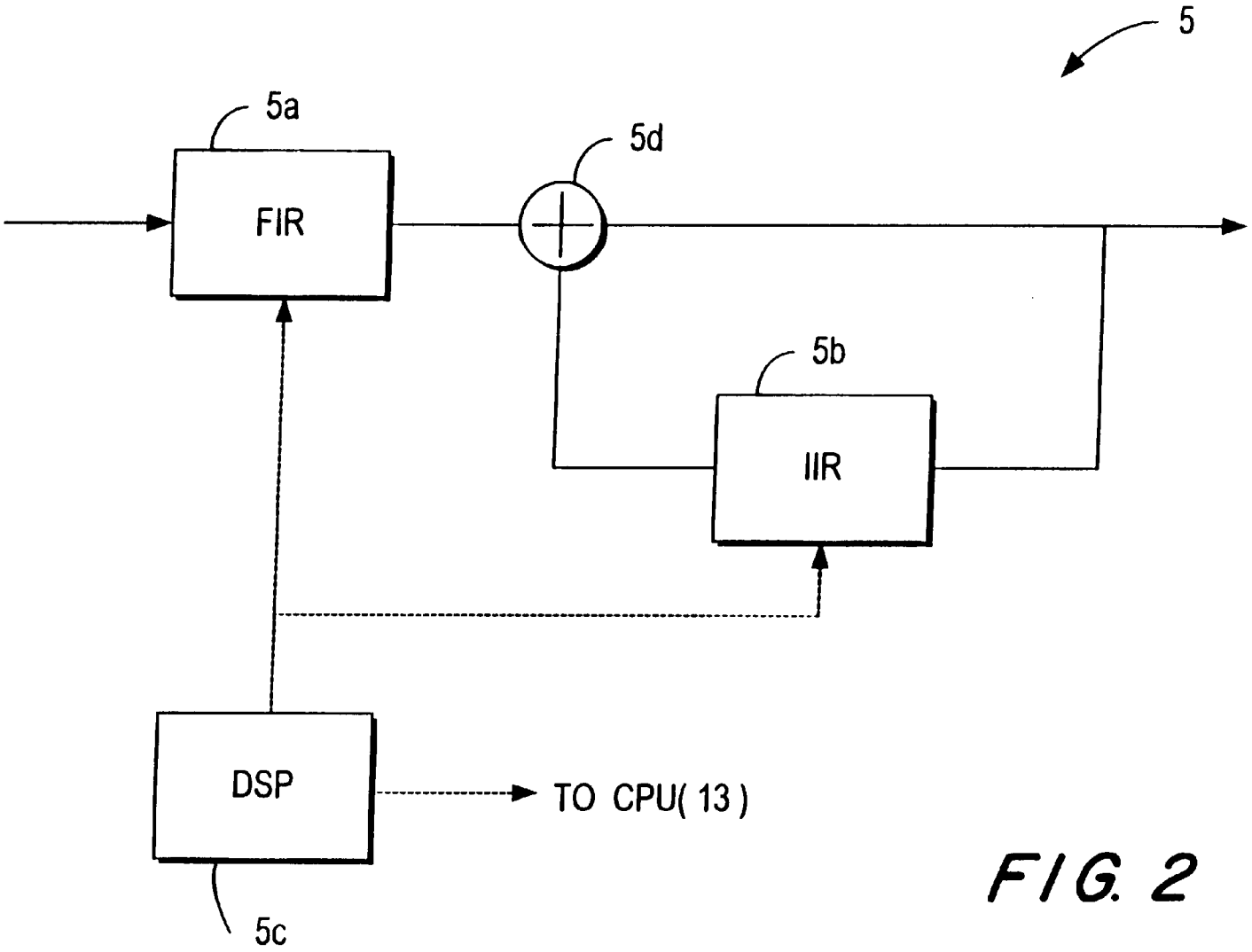
FIG. 2 is a diagram of an equalizer of the television receiver of FIG. 1.

As shown in FIG. 2, the equalizer 5 may include a finite impulse response (FIR) digital filter 5*a*, an infinite impulse response (IIR) digital filter 5*b*, and a digital signal processor (DSP) controller 5*c*. The FIR filter 5*a* may be a 64-tap FIR digital filter and the IIR filter 5*b* may be a 192-tap IIR digital filter. The FIR filter may be utilized to equalize so-called pre-ghost and post-ghost signals, and the IIR filter may be utilized to equalize post-ghost signals. In the equalizer 5, an output from the sync block 4 may be supplied to the FIR filter 5*a* and an output therefrom may be supplied to one input of an adder 5*d*. A summed output from the adder 5*d* may be outputted from the equalizer 5 for supply to the error correction circuit 6. The summed output from the adder 5*d* may also be supplied to the IIR filter 5*b* and an output therefrom may be supplied to another input of the adder. The DSP controller 5*c* is adapted to generate and provide control signals to the FIR and IIR filters 5*a* and 5*b* so as to control the equalizer tap-weights in the filters so that the signals inputted thereto may be equalized.

Figure 8A:
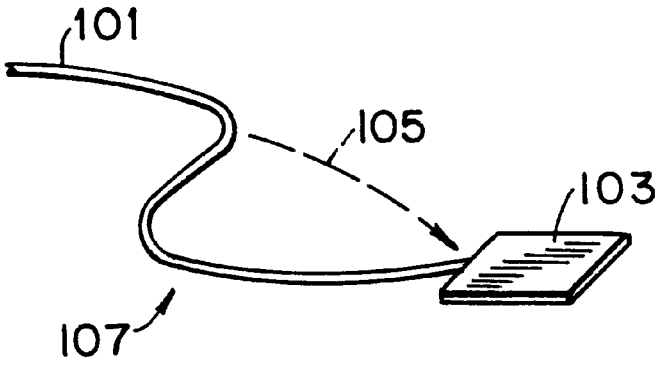
FIGS. 8A and 8B are diagrams to which reference will be made in explaining pre-ghost signals.
Figure 8B:
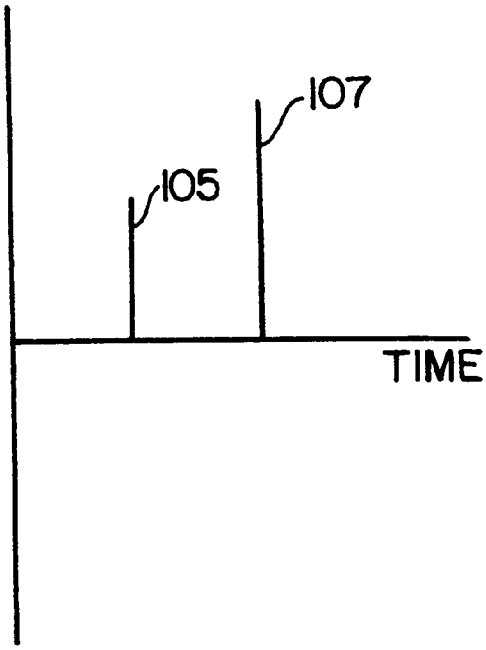
Figure 9A:
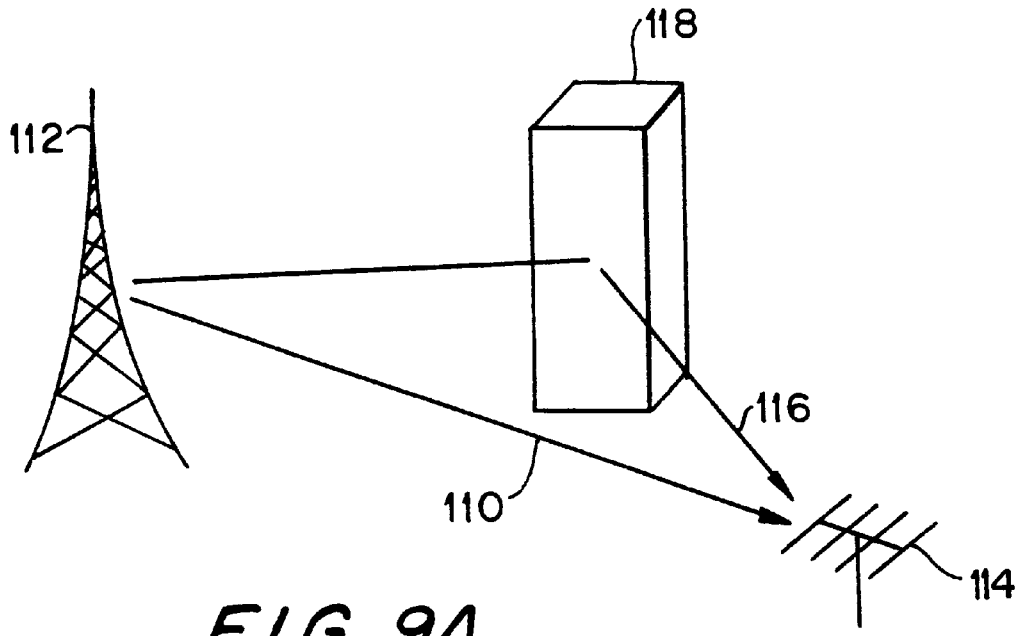
FIGS. 9A and 9B are diagrams to which reference will be made in explaining post-ghost signals.
Figure 9B:
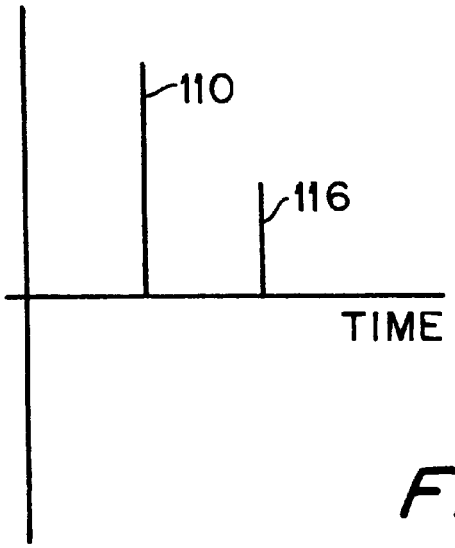

A pre-ghost or pre-ghost jumped signal 105 may occur when a signal is passed through a cable 101 which is arranged in a curved or unstraight manner (such as a "S" shaped arrangement) or the like such as that shown in FIG. 8A. Such arrangement may caused the pre-ghost signal 105 to "jump" or appear at a cable device 103 ahead of a normal signal 107, as indicated in FIG. 8B. A post-ghost signal may occur due to a reflection of a signal by a building or the like. For example, as shown in FIG. 9A, a signal 110 may be transmitted from a transmission tower 112. Such signal 110 may be directly received by a reception antenna 114 and may be reflected by a building 118 so as to form a post-ghost signal 116 which is received by the antenna. In such situation, as indicated in FIG. 9B, the signal 110 may be received by the antenna before the post-ghost signal 116.

As previously mentioned, the FIR filter 5*a* may have 64 equalizer tap-weights. Each equalizer tap-weight may be a 12 bit data having a range from −2047 to +2047. The micro-controller 13 downloads the equalizer tap-weights from the equalizer 5. As hereinbelow described, the micro-controller 13 may/utilize the tap weights from the FIR filter 5*a* to form an antenna value which provides an indication as to whether the antenna 1 is properly aligned.

Figure 3:
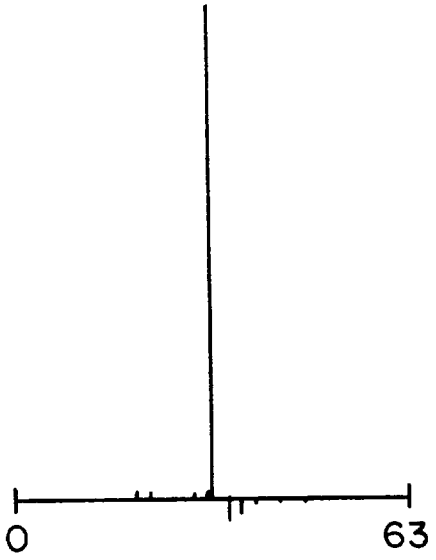
FIG. 3 is a diagram of equalizer tap-weight values to which reference will be made in explaining the operation of the present invention.
Figure 4:
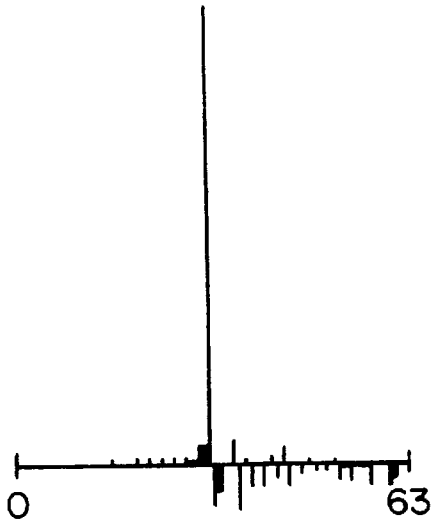
FIG. 4 is a diagram of equalizer tap-weight values to which reference will be made in explaining the operation of the present invention.
Figure 5:
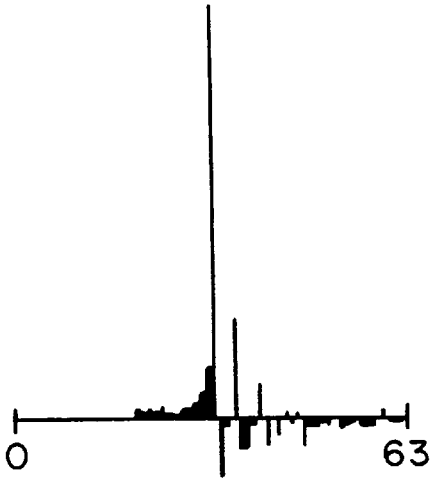
FIG. 5 is a diagram of equalizer tap-weight values to which reference will be made in explaining the operation of the present invention.

FIGS. 3 to 5 illustrate examples of equalizer tap-weight charts corresponding to various positions of the antenna 1 wherein the horizontal axis thereof represents tap numbers (0 to 63) and the vertical axis represents equalizer tap-weights values. In FIG. 3, the antenna 1 is properly aligned so as to point toward the transmission site. In this situation, a main positive peak and a number of smaller equalizer tap-weights appear. On the other hand, in FIGS. 4 and 5, the antenna 1 is aligned so as to respectively point 20 and 40 degrees from the proper position. As shown in these figures, some negative peaks may grow or increase as the antenna 1 moves away from the proper position. In particular, the largest negative peak may increase significantly. Accordingly, the antenna 1 is properly positioned when the negative peak is the smallest.

Let Av represent an antenna alignment value which may lie within a range from 0 to 100, where 0 represents a no signal condition (such as which may occur if the antenna 1 is not properly positioned) and 100 represents a full power reception condition (such as which may occur if the antenna 1 is properly positioned). As indicated by the formulas below, Av may be obtained from the largest negative peak value.

| | |
|---|---|
| Antenna alignment value: | Av (Range: 0 to 100) |
| Largest negative peak: | Pv (Range: −2047 to 0) |
| Normalized negative peak: | Pvn (Range 0 to 100) |

$Pvn = 100 + Pv$, when $Pv >= -100$
$Pvn = 0$, when $Pv < -100$
$Av = Pvn$

Figure 6:
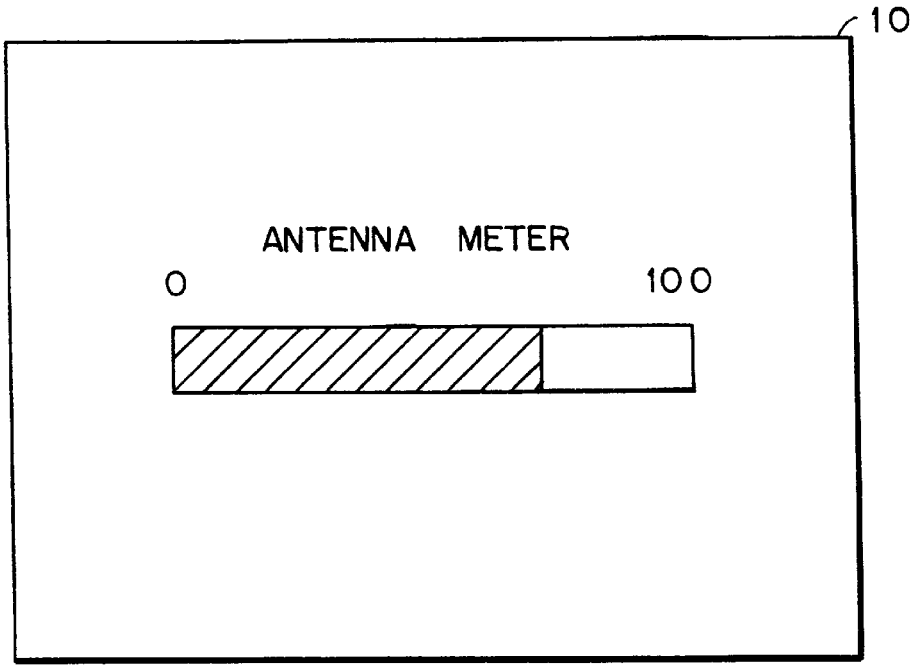
FIG. 6 is a diagram of an antenna meter.

In the system in FIG. 1, the micro-controller 13 may obtain the largest negative peak value from the equalizer 5 and may calculate the antenna alignment value (Av) therefrom. A signal corresponding to such antenna alignment value may be supplied to the video decoder 8 wherein a so-called On Screen Display (OSD) function may be activated, whereupon the antenna alignment value may be displayed on the CRT 10 as shown in FIG. 6.

The antenna alignment value Av displayed on the CRT 10 provides an indication as to whether the antenna 1 is properly positioned. That is, the antenna 1 is properly positioned when the antenna value is at or relatively close to 100, and the antenna is not properly positioned when the antenna value is at or relatively close to 0. As such, an installer may properly align or position the antenna 1 by moving the antenna until the antenna value Av has a relatively large value. Further, unlike the antenna alignment value or values produced merely from an error rate of received signals which do not gradually change as previously described, the antenna alignment value or values produced from equalizer tap-weight values may gradually change as the antenna 1 is rotated or moved. As is to be appreciated, such gradual changing of the antenna alignment values facilitates the aligning or positioning of the antenna 1 by an installer.

The present invention is not limited to the specific procedure described above. That is, such procedure may be modified in a number of ways. For example, instead of using a negative equalizer tap-weight peak in determining the antenna alignment value, the largest positive equalizer tap-weight peak value may be used. In this situation, the antenna 1 would be properly positioned when the positive peak has the largest value. As another example, a sum or an average of all or some of the negative equalizer tap-weights may be used in determining the antenna alignment value. As a further example, a sum or an average of all or some of the equalizer tap-weights except the largest positive peak may be used in determining the antenna alignment value.

Further, although in the above described procedure the equalizer tap-weights of FIR filter 5*a* are used in determining the antenna alignment value, the present invention is not so limited. For example, equalizer tap-weights of the IIR filter 5*b* or equalizer tap-weights from both the FIR and IIR filters may be used to obtain the antenna alignment value Av.

Furthermore, in addition to using equalizer tap-weights to determine an antenna alignment value as previously described, equalizer tap-weights and packet error rate (PER) (which may be obtained from the error correction circuit 6) may be utilized to determine the antenna alignment value. For example, an average of Pvn and PER may be used to determine the antenna alignment value Av as follows:

$$Av=(Pvn+PERn)/2$$

PERn represents normalized PER in the range from 0 to 100. In such situation, PER may have a value of 100 if no errors exist.

In addition to averaging, Pvn and PERn may be combined in other arrangements, such as a 2:1 ratio.

With regard to multi-channel reception, it may not be easy to receive two or more signals with one antenna. In such situation, although it may not be possible to orient the antenna so as to provide the best position for each signal, the antenna nevertheless should be oriented such that all of the signals may be received without error. As hereinbelow described, the present invention may also be used for facilitating the positioning of an antenna for multi-channel reception.

Figure 7:
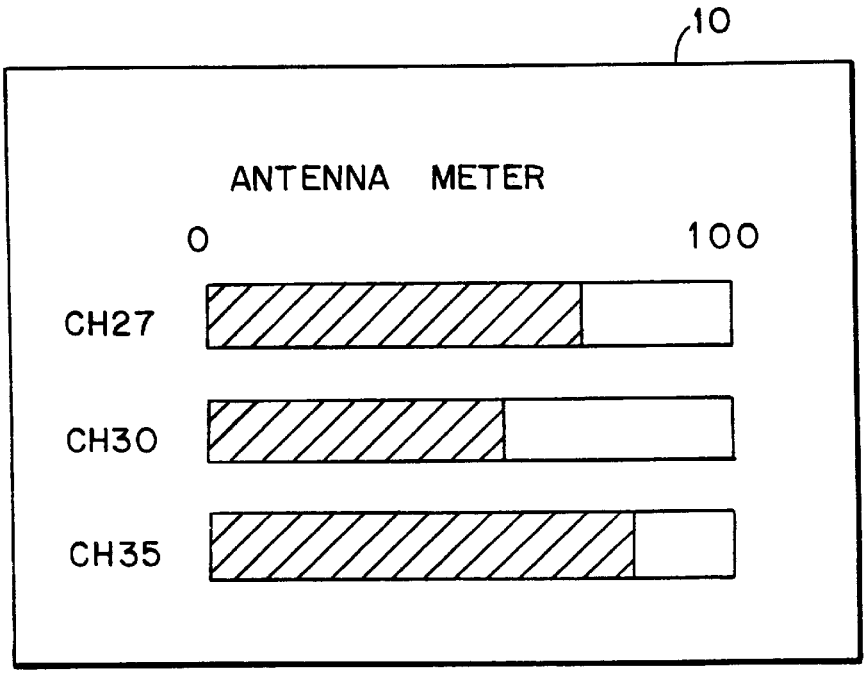
FIG. 7 is a diagram of an antenna meter having a plurality of values to which reference will be made in explaining an operation of the present invention.

Assume that a user wishes to receive three channels, that is, CH. 27, CH. 30, and CH. 35. In this situation, the installer may preset or select these channels with the use of the remote commander 15, whereupon signals corresponding thereto may be transmitted and received by the user interface 14 which, in turn, may supply the same to the micro-controller 13. Upon receipt thereof, the micro-controller 13 may supply a command to the tuner 2 to tune to CH. 27. After the tuner 2 tunes to CH. 27, the micro-controller 13 may obtain equalizer tap-weight data from the equalizer 5 and packet error rate data from the error correction circuit 6. The micro-controller 13 may calculate the antenna alignment value Av from such received data and may supply a signal corresponding to such value Av to the video decoder 8 wherein the OSD function may be activated and the antenna alignment value Av may be displayed on the CRT 10 as shown in FIG. 7, in a manner similar to that previously described. This process may be automatically repeated for each of the three preset channels one after another at fixed intervals. Such interval may be approximately 3 seconds. Thus, the installer does not have to manually set or change the channel for each of the three channels.

As a result, and as shown in FIG. 7, an antenna alignment value for each of the three channels may be displayed on the CRT 10. Accordingly, the installer does not select a first channel and view the first antenna alignment value and then (while remembering the first antenna alignment value) select a second channel and view a second antenna alignment value and so forth.

Thus, in multi-channel reception situations, the installer may be able to simultaneously view the antenna alignment values for each of the desired channels. Such simultaneous display of the antenna alignment values enables the installer to easily point or position the antenna 1 so that the antenna alignment value of each channel is relatively high.

Additionally, the aspects of the present multi-channel reception arrangement pertaining to the automatic and/or simultaneous display of items relating to each of the desired channels may also be applied to aligning antennas adaptable for receiving broadcasted analog NTSC signals or the like.

That is, consider the above-described situation in which a user wishes to receive three channels, that is, CH. 27, CH. 30, and CH. 35. In a manner similar to that previously described, the installer may preset or select these channels with the use of the remote commander 15, whereupon signals corresponding thereto may be transmitted and received by the user interface 14 which, in turn, may supply the same to the microcontroller 13 and, upon receipt thereof, the micro-controller 13 may supply a command to the tuner 2 to tune to CH. 27. In this situation, unlike in the previously described situation wherein alignment values are obtained and displayed, after the tuner 2 tunes to CH. 27, the video picture pertaining to CH. 27 is displayed on the CRT 10. This process may be automatically repeated for each of the three preset channels one after another at fixed intervals. Such interval may be approximately 3 seconds. Thus, in this situation, the installer does not have to manually set or change the channel after the receipt of each video picture.

Further, a video picture or pictures corresponding to each of the channels CH. 27, CH. 30, and CH. 35 may be simultaneously displayed on the CRT 10. In this situation, a predetermined amount of video picture data (such as that corresponding to one field or frame) for a number of the selected channels may be stored in a memory 98 which may be included within the video decoder 8 or may be located outside thereof. The CPU 13 may process such video data in a predetermined manner and supply the processed data to the decoder 8 which, in turn, may supply an output video signal to the CRT 10. The processing of each video field/frame by the CPU 13 may involve reduction processing wherein the size of the video field/frame when displayed may be reduced from a normal size to a reduced size so as to enable the video pictures of more than one of the channels, and preferably all of the channels, to be simultaneously displayed on the CRT 10. Accordingly, in this situation, the installer may be able to simultaneously view the video picture displays for each of the desired channels and does not have to select a first channel and view the first display and then (while remembering the first display) select a second channel and view a second display and so forth. Such simultaneous display of the video pictures corresponding to the selected channels enables the installer to easily and properly point or position an antenna.

Therefore, the present invention provides a technique for facilitating the positioning of an antenna adaptable for receiving broadcasted DTV signals wherein antenna alignment values obtained from equalizer tap-weight values are displayed so as to provide an indication as to whether or not the antenna is properly aligned. Such antenna alignment values may change gradually as the antenna is rotated or moved. As a result, an installer can easily position or point an antenna in the direction of the transmission site. Additionally, in multi-signal reception, a plurality of channels may be automatically tuned and/or simultaneously displayed so as to facilitate the positioning of the antenna.

Although preferred embodiments of the present invention and modifications thereof have been described in detail herein, it is to be understood that this invention is not limited to these embodiments and modifications, and that other modifications and variations may be effected by one skilled in the art without departing from the spirit and scope of the invention as defined by the appended claims.

What is claimed is:

1. A system for aligning an antenna adaptable for receiving a broadcasted signal, said system comprising:

means for obtaining a number of equalizer tap-weight values from the received signal; and means for determining an antenna alignment value from the obtained number of equalizer tap-weight values;

wherein said antenna alignment value indicates whether said antenna is properly aligned.

2. A system according to claim 1, further comprising means for displaying said antenna alignment value.

3. A system according to claim 1, wherein a maximum negative peak value is included within the obtained number of equalizer tap-weight values and wherein the determining means determines said antenna alignment value from said maximum negative peak value.

4. A system according to claim 1, wherein a maximum positive peak value is included within the obtained number of equalizer tap-weight values and wherein the determining means determines said antenna alignment value from said maximum positive peak value.

5. A system according to claim 1, wherein a number of negative values are included within the obtained number of equalizer tap-weight values and wherein the determining means determines said antenna alignment value from one of a sum of at least two of said number of negative values and an average of at least two of said number of negative values.

6. A system according to claim 1, wherein a maximum positive peak value is included within the obtained equalizer tap-weight values and wherein the determining means determines said antenna alignment value from one of a sum of at least two of the obtained equalizer tap-weight values except said maximum positive peak value and an average of at least two of the obtained equalizer tap-weight values except said maximum positive peak value.

7. A system according to claim 1, wherein the obtaining means includes a finite impulse response (FIR) filter and an infinite impulse response (IIR) filter and wherein the number of equalizer tap-weight values are obtained by use of at least one of said FIR filter and said IIR filter.

8. A system according to claim 1, further comprising means for determining an error rate of said received signal and wherein the determining means determines said antenna alignment value from the obtained number of equalizer tap-weight values and said error rate.

9. A system for aligning an antenna adaptable for receiving signals transmitted over a plurality of channels, said system comprising:

means for tuning to each channel of said plurality of channels so as to receive the signals transmitted over each of said plurality of channels and for obtaining therefrom a number of equalizer tap-weight values for each of said plurality of channels;

means for determining a respective antenna alignment value from the obtained number of equalizer tap-weight values for each of said plurality of channels; and means for displaying each said antenna alignment value so as to enable said antenna to be aligned in accordance therewith.

10. A system according to claim 9, wherein the tuning means automatically tunes to each of at least two of said channels such that the tuning means automatically tunes to a first channel so as to receive the signals transmitted over said first channel and, after a predetermined time interval, the tuning means automatically tunes to a second channel so as to receive the signals transmitted over said second channel.

11. A system according to claim 9, wherein the displaying means displays at least two antenna alignment values simultaneously.

12. A system for aligning an antenna adaptable for receiving a broadcasted signal, said system comprising:

an equalizer for obtaining a number of equalizer tap-weight values from the received signal; and a processor for determining an antenna alignment value from the obtained number of equalizer tap-weight values;

wherein said antenna is alignable in accordance with said antenna alignment value.

13. A,system according to claim 12, further comprising a display for displaying said antenna alignment value.

14. A system according to claim 12, wherein a maximum negative peak value is included within the obtained number of equalizer tap-weight values and wherein the processor determines said antenna alignment value from said maximum negative peak value.

15. A system according to claim 12, wherein a maximum positive peak value is included within the obtained number of equalizer tap-weight values and wherein the processor determines said antenna alignment value from said maximum positive peak value.

16. A system according to claim 12, wherein a number of negative values are included within the obtained number of equalizer tap-weight values and wherein the processor determines said antenna alignment value from one of a sum of at least two of said number of negative values and an average of at least two of said number of negative values.

17. A system according to claim 12, wherein a maximum positive peak value is included within the obtained equalizer tap-weight values and wherein the processor determines said antenna alignment value from one of a sum of at least two of the obtained equalizer tap-weight values except said maximum positive peak value and an average of at least two of the obtained equalizer tap-weight values except said maximum positive peak value.

18. A system according to claim 12, wherein the equalizer includes a finite impulse response (FIR) filter and an infinite impulse response (IIR) filter and wherein the number of equalizer tap-weight values are obtained by use of at least one of said FIR filter and said IIR filter.

19. A system according to claim 12, wherein the processor determines an error rate of said received signal and wherein the processor determines said antenna alignment value from the obtained number of equalizer tap-weight values and said error rate.

20. A system for aligning an antenna adaptable for receiving signals transmitted over a plurality of channels, said system comprising:

a tuner tunable to each channel of said plurality of channels so as to receive the signals transmitted over each of said plurality of channels;

an equalizer for obtaining a number of equalizer tap-weight values for each of said plurality of channels from the signals received by the tuner;

a processor for determining a respective antenna alignment value from the number of equalizer tap-weight values obtained by the equalizer for each of said plurality of channels; and a display for displaying each said antenna alignment value so as to enable said antenna to be aligned in accordance therewith.

21. A system according to claim 20, wherein the tuner automatically tunes to each of at least two of said channels such that the tuner automatically tunes to a first channel so as to receive the signals transmitted over said first channel and, after a predetermined time interval, the tuner automatically tunes to a second channel so as to receive the signals transmitted over said second channel.

22. A system according to claim 20, wherein the display displays at least two antenna alignment values simultaneously.

23. A method for aligning an antenna adaptable for receiving a broadcasted signal, said method comprising the steps of:

obtaining a number of equalizer tap-Weight.values from the received signal; and determining an antenna alignment value from the obtained number of equalizer tap-weight values;

wherein said antenna is aligned in accordance with said antenna alignment value.

24. A method according to claim 23, further comprising the step of displaying said antenna alignment value.

25. A method according to claim 23, wherein a maximum negative peak value is included within the obtained number of equalizer tap-weight values and wherein the determining step determines said antenna alignment value from said maximum negative peak value.

26. A method according to claim 23, wherein a maximum positive peak value is included within the obtained number of equalizer tap-weight values and wherein the determining step determines said antenna alignment value from said maximum positive peak value.

27. A method according to claim 23, wherein a number of negative values are included within the obtained number of equalizer tap-weight values and wherein the determining step determines said antenna alignment value from one of a sum of at least two of said number of negative values and an average of at least two of said number of negative values.

28. A method according to claim 23, wherein a maximum positive peak value is included within the obtained equalizer tap-weight values and wherein the determining step determines said antenna alignment value from one of a sum of at least two of the obtained equalizer tap-weight values except said maximum positive peak value and an average of at least two of the obtained equalizer tap-weight values except said maximum positive peak value.

29. A method according to claim 23, wherein the number of equalizer tap-weight values are obtained in the obtaining step by use of at least one of a finite impulse response (FIR) filter and an infinite impulse response (IIR) filter.

30. A method according to claim 23, further comprising the step of determining an error rate of said received signal and wherein the determining step determines said antenna alignment value from the obtained number of equalizer tap-weight values and said error rate.

31. A method for aligning an antenna adaptable for receiving signals transmitted over a plurality of channels, said method comprising the steps of:

tuning to each channel of said plurality of channels so as to receive the signals transmitted over each of said plurality of channels and obtaining therefrom a number of equalizer tap-weight values for each of said plurality of channels;

determining a respective antenna alignment value from the obtained number of equalizer tap-weight values for each of said plurality of channels; and displaying each said antenna alignment value so as to enable said antenna to be aligned in accordance therewith.

32. A method according to claim 31, wherein each of at least two of said channels are automatically tuned to in the tuning step such that a first channel is automatically tuned to so as to receive the signals transmitted over said first channel and, after a predetermined time interval, a second channel is automatically tuned to so as to receive the signals transmitted over said second channel.

33. A method according to claim 31, wherein at least two antenna alignment values are simultaneously displayed in the displaying step.

* * * * *